US011359289B2

(12) United States Patent
Metscher et al.

(10) Patent No.: US 11,359,289 B2
(45) Date of Patent: Jun. 14, 2022

(54) METHOD FOR COATING A COMPONENT FOR THE HOT GAS DUCT OF A TURBOMACHINE

(71) Applicant: MTU Aero Engines AG, Munich (DE)

(72) Inventors: Martin Metscher, Munich (DE); Benedikt Heidenreich, Munich (DE); Jan Haegert, Gilching (DE); Nils Hiller, Munich (DE); Patrick Lang, Munich (DE)

(73) Assignee: MTU Aero Engines AG, Munich (DE)

( * ) Notice: Subject to any disclaimer, the term of this patent is extended or adjusted under 35 U.S.C. 154(b) by 125 days.

(21) Appl. No.: 16/033,984

(22) Filed: Jul. 12, 2018

(65) Prior Publication Data

US 2019/0017174 A1 Jan. 17, 2019

(30) Foreign Application Priority Data

Jul. 14, 2017 (DE) ..... 10 2017 212 075.4

(51) Int. Cl.

| | |
|---|---|
| ***C23C 24/08*** | (2006.01) |
| ***F01D 25/16*** | (2006.01) |
| ***F01D 5/28*** | (2006.01) |
| ***F01D 9/00*** | (2006.01) |
| ***F01D 25/00*** | (2006.01) |

(Continued)

(52) U.S. Cl.

CPC ..... *C23C 24/087* (2013.01); *C23C 10/04* (2013.01); *C23C 10/18* (2013.01); *C23C 10/20* (2013.01); *C23C 10/30* (2013.01); *C23C 10/48* (2013.01); *C23C 10/50* (2013.01); *C23C 12/02* (2013.01); *F01D 5/288* (2013.01); *F01D 9/00* (2013.01); *F01D 25/005* (2013.01); *F01D 25/162* (2013.01); *F05D 2230/31* (2013.01); *F05D 2230/40* (2013.01); *F05D 2230/80* (2013.01); *F05D 2230/90* (2013.01);

(Continued)

(58) Field of Classification Search

CPC ..... C23C 24/087

See application file for complete search history.

(56) References Cited

U.S. PATENT DOCUMENTS 5,607,720 A * 3/1997 Wallace ..... B05B 7/1445 427/181

6,305,077 B1 * 10/2001 Conner ..... C23C 10/02 29/889.1

(Continued)

FOREIGN PATENT DOCUMENTS

DE 102008039969 A1 3/2010

DE 102009008510 A1 8/2010

(Continued)

OTHER PUBLICATIONS

WO2010091667, machine translation, Aug. 9, 2010. (Year: 2010).*

*Primary Examiner* — Robert A Vetere

(74) *Attorney, Agent, or Firm* — Barlow, Josephs & Holmes, Ltd.; David R. Josephs

(57) ABSTRACT

The invention relates to a method for coating a component, which is provided for the hot gas duct of a turbomachine, wherein the coating material is applied onto the uncoated component surface in the form of particles in mixture with a binding agent, and the component with the particle-treated binding agent thereupon then undergoes thermal treatment in such a way that the binding agent is released and the coating material remains on the component.

11 Claims, 3 Drawing Sheets

(51) Int. Cl.

| | |
|---|---|
| ***C23C 10/20*** | (2006.01) |
| ***C23C 10/18*** | (2006.01) |
| ***C23C 10/48*** | (2006.01) |
| ***C23C 12/02*** | (2006.01) |
| ***C23C 10/30*** | (2006.01) |
| ***C23C 10/50*** | (2006.01) |
| ***C23C 10/04*** | (2006.01) |

(52) U.S. Cl.
CPC ..... *F05D 2240/10* (2013.01); *F05D 2240/50* (2013.01); *F05D 2300/121* (2013.01); *F05D 2300/17* (2013.01)

(56) References Cited

U.S. PATENT DOCUMENTS

| | | | | |
|---|---|---|---|---|
| 6,749,356 | B1 | 6/2004 | Mead et al. | |
| 6,924,038 | B1 * | 8/2005 | Hardy | C23C 10/04 264/122 |
| 2005/0095358 | A1 * | 5/2005 | Park | C23C 10/30 427/140 |
| 2006/0177686 | A1 | 8/2006 | Henager, Jr. et al. | |
| 2007/0196686 | A1 | 8/2007 | Nagaraj et al. | |
| 2011/0206533 | A1 | 8/2011 | Lee et al. | |
| 2015/0079278 | A1 | 3/2015 | Stapel et al. | |

FOREIGN PATENT DOCUMENTS

| | | | | |
|---|---|---|---|---|
| EP | 1528117 | A1 | 5/2005 | |
| EP | 1553145 | A1 | 7/2005 | |
| EP | 2371986 | A1 | 10/2011 | |
| WO | 2006061431 | A2 | 6/2006 | |
| WO | WO-2010091667 | A1 * | 8/2010 | C23C 10/08 |
| WO | 2013149609 | A1 | 10/2013 | |

* cited by examiner

METHOD FOR COATING A COMPONENT FOR THE HOT GAS DUCT OF A TURBOMACHINE

BACKGROUND OF THE INVENTION

The present invention relates to a method for coating a component that is provided for arrangement in the hot gas duct of a turbomachine.

The turbomachine can be, for example, a jet engine, such as, for example, a turbofan engine. In functional terms, the turbomachine is subdivided into compressor, combustion chamber, and turbine. In the case of a jet engine, for instance, intake air is compressed by the compressor and combusted with admixed kerosene in the downstream combustion chamber. The resulting hot gas, which is a mixture of combustion gas and air, flows through the downstream turbine and is expanded in this way. The volume through which the hot gas flows, that is, the path from and including the combustion chamber over the turbine up to the nozzle, is referred to as the "hot gas duct."

The present subject relates to a component that is provided for arrangement in the hot gas duct, but in this case, it is not intended to be explicitly limited initially to the jet engine referred to for illustration. The turbomachine can also be a stationary gas turbine, for example.

SUMMARY OF THE INVENTION

The present invention is based on the technical problem of presenting an especially advantageous method for coating a component that is provided for arrangement in the hot gas duct of a turbomachine.

In accordance with the invention, this object is achieved with the method disclosed below. A binding agent, which contains the coating material or a precursor thereof in particulate form, is thus initially applied to the uncoated surface of the component. The component, which is covered in some regions with the particle-treated binding agent, then undergoes thermal treatment, during which the binding agent is released and the coating material remains on the component (at the surface or also diffused inward).

Preferred embodiments are presented in the dependent claims and in the entire description, without a distinction always being made in detail between the coating method and a manufacturing method during the course of which the coating is carried out on a corresponding component. In general, the disclosure is to be read relative to all categories of the claims.

The coating can be used, for example, to protect a region of the component that, on account of a high flow velocity or temperature of the hot gas, for example, is particularly at risk of oxidation or hot-gas corrosion. Conversely, the inventors have found that a coating of the entire surface exposed to the hot gas can be detrimental in aerodynamic terms, because, as a rule, the coating has a rougher surface than, for example, an uncoated, ground, or polished component. A postprocessing of the coating itself by material-removing processing, for instance, can be problematic, on the other hand, in regard to crack formation in adjacent layer regions, for example, and, for this reason, can be less desirable (a postprocessing by tumbling or barrel finishing is conceivable, but would not enable the only slight roughness of polished surfaces to be obtained or would enable it to be obtained only with difficulty). Ideally, therefore, only a region of the component surface that is particularly at risk of oxidation is coated.

Such a coating of the surface in only some regions can be accomplished in an advantageous way by the proposed method. The particle-treated binding agent can be applied in a comparably targeted manner—namely, comparably to a lacquer—onto the region to be coated. When the binding agent is sprayed on, the region to be coated and an adjacent region to be excluded from the coating can be defined by a simple, solely local mask, for example. Alternatively, the particle-treated binding agent can also be brushed on or painted on, for which purpose a mask need not be required. If, alternatively, it is desired to deposit the coating material from the gas phase, for example, the component would need to be covered in a far more complicated manner, and nearly over its entire extent, in contrast, on account of the undirected deposition that acts from all sides, and only the regions to be coated could be left uncovered. However, small components, in particular, can obviously be coated entirely or at their entire surface exposed to the hot gas (the aerodynamic influence can be less here; in comparison to a gas-phase deposition in conjunction with the covering of functional surfaces, economic advantages can ensue).

Such a coating solely in some regions and for which specific regions remain uncoated, is also advantageous in comparison to a complete coating followed by removal of the coating in some regions—for example, in functional surfaces that are to undergo material removal. In this way, namely, it is possible to avert the risk of crack formation in the coating due to said removal.

In general, in the scope of this disclosure, "a" and "an" are to be read as indefinite articles and hence, unless explicitly stated otherwise, are always to be read as "at least one." Therefore, for example, insofar as it is mentioned that "a region" of the component surface is coated, this is obviously not to be read to mean that only a single region is to be coated; in fact, the coating of a plurality of regions may even be preferred (see the exemplary embodiment for illustration).

The coating material is applied to the "uncoated" component surface; that is, the component has not already been coated at least in the region in question and preferably has not already been coated in its entirety. "Coating" is understood here to mean a layer on the surface, which is permanent insofar as it would not be released in the course of heat treatment. In general, therefore, it is conceivable, for example, that, prior to the application of the particle-treated binding material, a coat of the binding agent without any admixture of particles is applied (accordingly, this coat would not be a layer in that it would be released in the course of thermal treatment). Preferably, however, the particle-treated binding agent is applied directly onto the component surface itself, that is, directly onto any material with which the component is provided. The applied coat of the particle-treated binding agent can have a surface area of at least 10 $cm^2$, 20 $cm^2$, or 30 $cm^2$ per region in question, for example (possible upper limits depend on the component size, but can be, for example, at most 200 $cm^2$ or 100 $cm^2$).

The particles are embedded in the binding agent. Preferred is a liquid binding agent, which, in particular, can be viscous (highly viscous). The particles and the binding agent together preferably form a suspension and can be mixed together, for example, directly prior to application, with a stirrer, for instance, in order to obtain a distribution of particles that is as uniform as possible. The binding agent can be provided on a polymer base, for example; for instance, it can be provided as a dispersion in aqueous solution or in another solvent. The binding agent can also have constituents that evaporate when the applied coat dries, prior to thermal treatment. However, even after any drying, a part of the binding agent remains and is then released in the course of thermal treatment and, for example, evaporates or fumes off.

Generally conceivable is also a coating material that assumes its final chemical structure only in the course of the thermal treatment. For this reason, the binding agent can also be treated with a precursor of the coating material, which is transformed into the layer material in a chemical reaction that proceeds during the thermal treatment (such a precursor can also be a multi-component precursor). Preferably, however, the coating material is already blended into the binding agent in its final chemical form as an element or compound.

In a preferred embodiment, the particles comprise aluminum, which diffuses proportionately into the surface of the component during the thermal treatment. Particles composed of an aluminum alloy are also conceivable, for example; particles that are composed of pure aluminum within the technically conventional scope are preferred. Alternatively conceivable in general, for example, would also be a ceramic coating material. In general, the component is preferably a metal component; that is, the component is provided from a metal material, such as, for example, an alloy. Quite generally, a material exhibiting high-temperature resistance can be advantageous for the component.

In a preferred embodiment, the component can be provided from a nickel alloy. This refers to the component apart from the coating material; in conjunction with the nickel alloy, the coating material is more preferably aluminum; see the above. The component can be provided from a nickel-based alloy, for example, also from a nickel-based superalloy, which can be optimized in terms of its creep strength or fatigue strength by co-alloying it with additional constituents. For example, titanium and/or aluminum or also chromium, cobalt, etc., for example, can be co-alloyed.

In a preferred embodiment, an organic-based binding agent is provided, such as, for example, an epoxy resin-based or alkyd resin-based binding agent. The binding agent undergoes pyrolysis during the thermal treatment and evaporates or fumes off.

In a preferred embodiment, the temperature during the thermal treatment is at least 800° C., further and especially preferred, at least 850° C. or 900° C. Preferred upper limits can be, for example, at most 1200° C., 1150° C., 1100° C., or 1050° C., wherein the upper limits generally shall also be disclosed independently of the lower limits, and vice versa. The component can be held in an appropriate temperature range for a period of at least 30 minutes or 60 minutes, for example, with possible (independent thereof) upper limits of, for example, at most 24 hours or 12 hours. A temperature of around 980° C. can be especially preferred. Particularly in the case of the aforementioned aluminum, the thermal treatment can also be regarded as diffusion annealing, in which not only is the binding agent released, but also the aluminum diffuses into the surface of the component.

In a preferred embodiment, a surface-area proportion of at least 10%, further and especially preferred at least 15% or 20%, of the entire surface area of the component exposed to the hot gas is coated with the particle-treated binding agent; the "surface exposed to the hot gas" is the part of the entire component surface around which flows the hot gas in the hot gas duct. In general and also depending on the lower limits, preferred upper limits are at most 80%, 70%, 60%, or 50% (increasingly preferred in the named sequence). Additionally or alternatively, however, it is also possible for surface regions of the component to be coated that are not exposed to the hot gas (that lie outside of the hot gas duct). These surface regions, too, can be at risk of oxidation or they can be correspondingly hot zones in the secondary air system.

Conversely, therefore, in the finished coated component, a proportion of at least 20%, 30%, 40%, or 50% of the surface exposed to the hot gas is uncoated and therefore is then in direct contact with the hot gas. Initially, as depicted above, this can offer advantages in terms of aerodynamics, because the uncoated surfaces can be smoothed or can become smoothed through polishing, for example. Even though, in general, a smoothing post-treatment of the coating itself is conceivable—for example, though tumbling or barrel finishing—preferably no postprocessing occurs. The component surface is preferably smoothed prior to the coating and, in particular, is ground (also independent of the mentioned surface-area proportions).

At least one functional surface region of the entire component surface remains uncoated. This functional surface region represents a mounting boundary when the component is assembled with another component or other components in the turbomachine. What is involved may be, for example, a support surface with which the component then rests against another component. It is advantageous in this case with regard to the dimensional accuracy and thus the accuracy of fit when the functional surface region remains uncoated in the finished coated component. In this regard also, an advantage of the presently described method can be manifested, in particular, in the good possibility of selective application in some regions (in gas phase deposition, the covering of the functional surface regions entails markedly more effort).

In a preferred embodiment, the particle-treated binding agent is applied sequentially in a plurality of coats prior to the thermal treatment. Thus initially, a first coat is applied directly onto the component surface, and subsequently, at least one additional coat is applied onto at least one region of the first coat and, if need be, proportionately also onto a surface region that was hitherto uncovered. The coats should have at least one overlap and can also be coextensive. Through the sequential application, for example, it is possible to prevent any streaking or a non-uniform particle application. It is thus possible to set the desired quantity of coating material, depending on the surface-area region, in a readily reproducible manner. After the application of a coat and prior to the application of the following coat, drying is preferably carried out at a temperature of, for example, 50° C., preferably 100° C., with possible upper limits (dependent thereon) being at most 250° C. or 200° C., for example. Alternatively or additionally, drying can also be carried out by UV irradiation. Preferably, drying is carried out after the application of each of the coats.

If a plurality of coats are applied, only a partial and not a complete overlap of these coats may also be of interest. Thus, the coats can overlap, for example, in a region (for example, at the leading edge and/or at the trailing edge; see below for details) that is especially at risk of oxidation. In a transition to a region that is less at risk of oxidation (for example, the lateral surfaces), it is then also possible to apply only one coat, so that, therefore, a certain (stepped) progression is set. Through the overlapping coats in the region that is at risk of oxidation, relatively more coating material is applied there. With the only one coat, less coating material is present in the transition region (less coating material is also needed there) and this can be of advantage, for example, in a lesser surface roughness and accordingly can also be advantageous in terms of aerodynamics and structural mechanics.

The component will be discussed further in detail below.

In a preferred embodiment, the component has a leading edge and a trailing edge with respect to the flow in the hot gas duct as well as two lateral surfaces, each of which extends between the leading edge and the trailing edge. Preferably, the component serves as a cladding of the turbine center frame (see below). Regardless thereof in detail, the leading edge and/or the trailing edge is/are preferably covered with the coating and, especially preferably, both of them are covered. In relation to the extent of the respective edge (leading edge or trailing edge), the coating should in any case cover a major part thereof, that is, at least 50%, 60%, 70%, or 80% (increasingly preferred in the named sequence). Preferably, the lateral surfaces each remain uncoated at least in some regions and this can be of aerodynamic advantage (see above). A respective coating can extend around the corresponding edge and thereby further into the two lateral surfaces, but should not thereby be present continuously up to the other respective edge.

The component is provided for arrangement in a turbine center frame. The component can be, for example, a so-called panel (also referred to as a hot gas duct panel), which is arranged in the inner shroud or outer shroud.

In a preferred embodiment, the component is provided in the turbine center frame as cladding of a support strut supporting the bearing of the turbine shaft. The bearing of the turbine shaft is borne circumferentially, in relation to a revolution around the axis of rotation of the turbine shaft, by a plurality of support struts, which are clad for aerodynamic and thermal reasons. These claddings are also referred to as fairings. Such a fairing has a leading edge and a trailing edge as well as lateral surfaces (see above) and is therefore constructed in principle as a guide vane. Reference is made to the preceding remarks in regard to the preferred coating of the leading edge and trailing edge.

In a preferred embodiment, the region to be coated is masked with a mask; that is, a surrounding surface region is covered. Even though, in general, an application of the particle-treated binding agent is also conceivable, for example, by brushing or tamping, spraying is preferred. In this case, the mask prevents any particle application to regions that are to remain uncoated. Preferably, a mask that is held to the component as an overall contiguous part is not adhesively attached, thereby enabling a high throughput. Preferably, the mask is complementary in form to a surface contour of the component and it is discontinuous in the region to be coated.

The invention relates not only to the first coating in the course of component manufacture, but also to a method for revising and re-coating a used component. In this case also, a particle-treated binding agent is applied; in regard to further details (preferred particles, etc.), reference is made explicitly to the above disclosure. Preferably, in the course of the revision, the same mask as for the first coating is utilized; that is, at least one identically constructed mask (if need be, even actually the same mask) is utilized.

The invention further relates to a method for manufacturing a coated component, wherein the component is coated in a presently described way.

The invention further also relates to a component coated in accordance with the invention.

BRIEF DESCRIPTION OF THE DRAWINGS

The invention will be explained in detail below on the basis of an exemplary embodiment, wherein the individual features in the scope of the independent claims can also be essential to the invention in other combinations, and also no distinction is further made in detail between the different claim categories.

The invention is shown in the following figures.

DESCRIPTION OF THE INVENTION

Figure 1A:
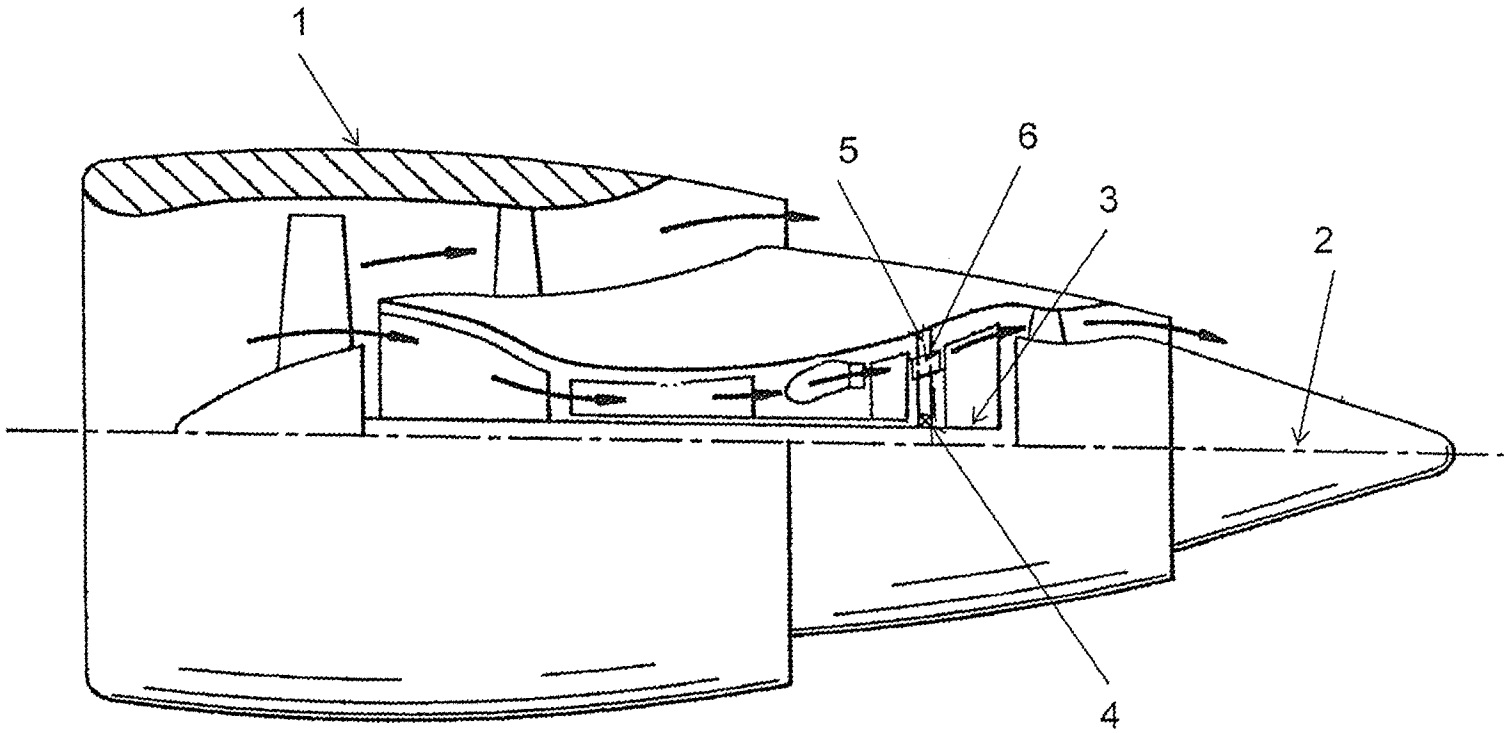
FIG. 1*a* shows a jet engine in a partially cut-away side view, schematic view.
Figure 1B:
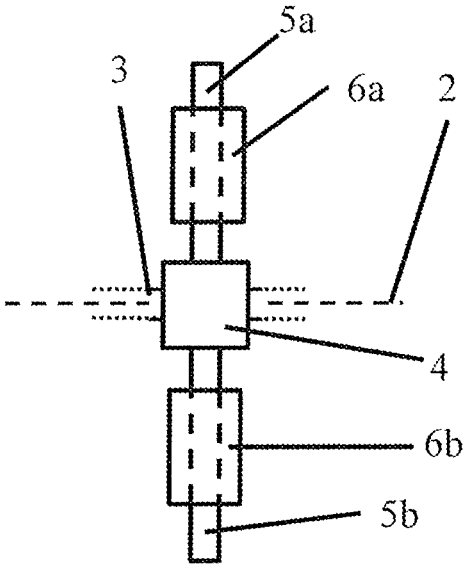
FIG. 1*b* shows a schematic detail view relating to FIG. 1*a;*

FIG. 1*a* shows a turbomachine 1 in a partially cut-away side view, specifically a jet engine. FIG. 1*b* shows a schematic detail view for the latter; the following remarks relate to both figures. In terms of function, the turbomachine 1 is subdivided into compressor, combustion chamber, and turbine. Both the compressor and the turbine are each made up of a plurality of stages (not illustrated). Each stage is composed of a guide vane ring and a rotating blade ring. During operation, the rotating blade rings rotate around the longitudinal axis 2 of the turbomachine 1. The turbine shaft 3 is mounted in a bearing 4, which is held by support struts 5 (shown partially by dashed lines) in the rest of the turbomachine 1. In the region of the hot gas duct, each of the support struts 5 is clad for aerodynamic and thermal reasons, namely, by a component 6, which represents a cladding and is also referred to as a fairing.

The method according to the invention has proven to be particularly advantageous especially for the coating of fairings or panels, because, in the case of these specific surface areas, processing by material removal is carried out after the coating process. By way of the coating in some regions by spraying and/or brushing (also referred to as so-called "touch-up" coating), it is possible during subsequent process steps to prevent any crack formation due to a local removal of the coating. In addition, it is also possible to avoid a complicated full-extent coverage for a local coating by gas-phase deposition.

Figure 2:
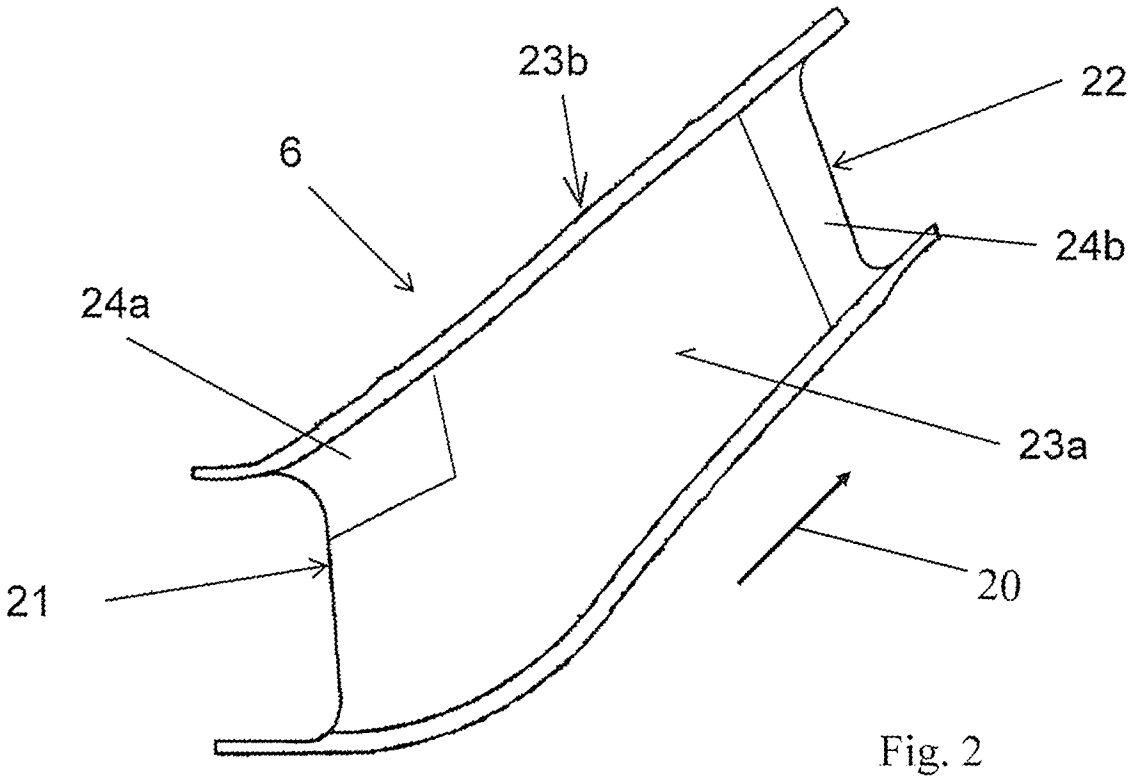
FIG. 2 shows, in a side view, a fairing of a support strut from the turbine center frame.

FIG. 2 shows such a fairing in an oblique view; not illustrated are the inner and outer shroud sections thus typically formed in one casting. With respect to the hot-gas flow 20, the fairing shows a leading edge 21 and a trailing edge 22 as well as, in addition, two respective lateral surfaces 23*a,b* that join the leading and trailing edges 21, 22 to each other and lie opposite to each other. The leading and trailing edges 21, 22 are each furnished with a coating 24. The coatings 24*a,b* cover the edges 21, 22 over the major part of their extent in each case, but, conversely, leave the lateral surfaces 23*a,b* partially uncoated. This has aerodynamic reasons—compare the introduction to the description for details. Such a coating only in some regions can be achieved with the method described below in an especially advantageous way.

Figure 3A:
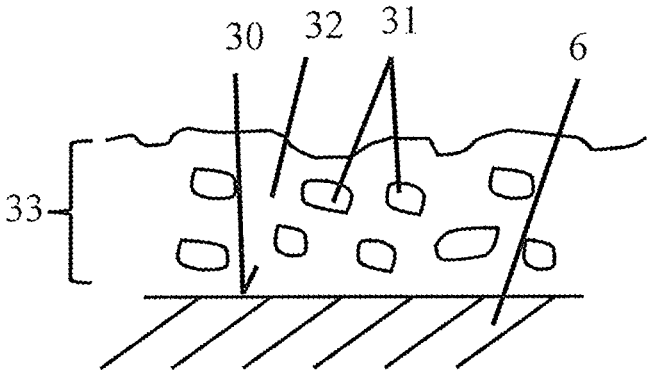
FIG. 3*a* shows a schematic section through a region of the component in accordance with FIG. 2 for illustration of an intermediate step of the coating method.

FIG. 3*a* shows a schematic section of the component 6 in a region that is coated. The component is provided from a nickel alloy and is coated with aluminum, which, however, is not deposited from the gas phase onto the uncoated surface 30 of the component 6. Instead, the aluminum is kept in a binding agent 32 in the form of particles 31, and this suspension, that is, the particle-treated binding agent 32, is applied onto the uncoated component surface 30. The binding agent 32 can be provided, for example, on an epoxy resin base, the particles 31 are admixed, and distributed uniformly by stirring prior to application, for example. The suspension can be sprayed on, comparably to a lacquer.

Figure 3B:
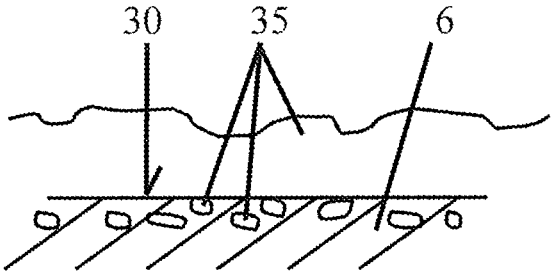
FIG. 3*b* shows, likewise in a section, a layer produced in accordance with the coating method.

In a next step, the component 6, onto which a coat 33 of the particle-treated binding agent 32 was applied, undergoes thermal treatment at a temperature of around 980° C. During this diffusion annealing, on the one hand, the binding agent 32 undergoes pyrolysis and vaporizes, and, on the other hand, the aluminum also diffuses proportionately into the surface 30 of the component 6. This is shown in FIG. 3*b*, in which the coating material 35, that is, the aluminum, is situated in part at the surface 30, but is also proportionately diffused inward. This results in a coating that well protects against oxidation the regions at and around the leading and trailing edges 21, 22 that are especially at risk of oxidation.

Although the present invention has been described in detail on the basis of the exemplary embodiments, it is obvious to the person skilled in the art that the invention is not limited to these exemplary embodiments, but rather that modifications are possible in such a way that individual features are omitted or other types of combinations of features can be realized, without leaving the scope of protection of the appended claims. In particular, the present disclosure encompasses all combinations of the individual features shown in the different examples of embodiment, so that individual features that are described only in conjunction with one exemplary embodiment can also be used in other exemplary embodiments, or combinations of individual features that are not explicitly shown can also be employed.

What is claimed is:

1. A method for coating a component with a coating material, which component is provided for arrangement in the hot gas duct in a turbine center frame of a turbomachine, as a hot gas duct panel or as a fairing of a support strut supporting the bearing of the turbine shaft, comprising the steps of:

keeping the coating material or a precursor thereof in the form of particles in mixture with a binding agent;

applying a coat of the particle-treated binding agent onto a region of the component the entirety of which is not precoated; and thermally treating the component with the particle-treated binding agent on it so that the binding agent is released and the coating material remains on the component; and wherein the second region is a functional surface-area region of the surface of the component that represents a mounting boundary in regard to an assembly of the component with other components in the turbomachine, which remains uncoated, and wherein a surface-area proportion of at least 10% of a portion of the surface of the component exposed to the hot gas is coated and at least 20% of the surface exposed to the hot gas is uncoated; and wherein the particle-treated binding agent is applied prior to the step of thermally treating sequentially in at least two non-coextensive coats, which have at least one partial overlap with one another on the surface of the component providing a progressive stepped coating.

2. The method according to claim 1, wherein the particles comprise aluminum, which diffuses proportionately into the surface of the component during the thermal treatment and/or in which the coat is applied by spraying and/or by brushing, in particular locally.

3. The method according to claim 1, wherein the component is made of a nickel alloy.

4. The method according to claim 1, wherein the binding agent is provided on an organic base and undergoes pyrolysis during the thermal treatment.

5. The method according to claim 1, wherein the step of thermally treating the component is carried out at least at 800° C. and at most at 1200° C.

6. The method according to claim 1, wherein a surface-area proportion of at most 80% of a portion of the surface of the component exposed to the hot gas is coated.

7. The method according to claim 1, wherein, in relation to a flow in the hot gas duct, the component has a leading edge and a trailing edge as well as, further, two lateral surfaces that join the leading edge and the trailing edge to each other, wherein the leading edge and/or the trailing edge are each coated at least over a major part of their respective extent, but the lateral surfaces each remain uncoated at least in some regions.

8. The method according to claim 1, wherein the region of the surface on which the particle-treated binding agent is applied is masked with a mask during the application of the particle-treated binding agent.

9. The method according to claim 8, further comprising the steps of:

providing a used component that was coated with the coating material;

revising and re-coating the used component, wherein, also during the re-coating, a particle-treated binding agent is applied using the same mask for the re-coating.

10. The method according to claim 1, wherein the component is coated only in regions, by use of a local masking, and a region that is unmasked during the coating remains uncoated.

11. The method according to claim 10, wherein a coated component is configured and arranged for use in a hot gas duct of a turbomachine.

* * * * *